US006854840B2

(12) United States Patent
Rao et al.

(10) Patent No.: US 6,854,840 B2
(45) Date of Patent: Feb. 15, 2005

(54) INK JET PRINTING PROCESS

(75) Inventors: Yuanqiao Rao, Pittsford, NY (US); Robert J. Kress, Rochester, NY (US); Lawrence P. Demejo, Rochester, NY (US); Sandra D. Nesbitt, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 141 days.

(21) Appl. No.: 10/228,689

(22) Filed: Aug. 27, 2002

(65) Prior Publication Data

US 2004/0041891 A1 Mar. 4, 2004

(51) Int. Cl.[7] ..... B41J 2/01
(52) U.S. Cl. ..... 347/101; 347/105
(58) Field of Search ..... 347/101, 102, 347/103, 104, 105; 428/22.1, 195

(56) References Cited

U.S. PATENT DOCUMENTS

| | | | | | |
|---|---|---|---|---|---|
| 5,644,350 | A | * | 7/1997 | Ando et al. | 347/101 |
| 6,087,051 | A | | 7/2000 | Shoji et al. | |
| 2003/0112311 | A1 | * | 6/2003 | Naik et al. | 347/105 |
| 2003/0134212 | A1 | * | 7/2003 | Castle et al. | 430/63 |
| 2003/0151654 | A1 | * | 8/2003 | Lawrence et al. | 347/105 |

* cited by examiner

*Primary Examiner*—Stephen D. Meier
*Assistant Examiner*—Alfeed Dudding
(74) *Attorney, Agent, or Firm*—Harold E. Cole; Chris P. Konkol

(57) ABSTRACT

An ink jet printing process for improving the durability and image quality of an ink jet image having the steps of a) providing an ink jet recording element having a support having thereon an image-receiving layer containing an ink jet image; and b) applying over the surface of the image-receiving layer an overcoat layer of water-dispersible, smectite clay particles.

13 Claims, No Drawings

INK JET PRINTING PROCESS

CROSS REFERENCE TO RELATED APPLICATIONS

Reference is made to commonly-assigned copending U.S. patent application Ser. No. 09/617,152, filed Jul. 17, 2000 entitled "Image Layer Comprising Intercalated Clay Particles", of Majumdar, et al; and U.S. patent application Ser. No. 09/742,982, filed Dec. 20, 2000, entitled "Ink Jet Printing Process", of Romano, Jr., et al.

FIELD OF THE INVENTION

This invention relates to an ink jet printing process for improving the durability and image quality of an ink jet image.

BACKGROUND OF THE INVENTION

Ink jet printing is a non-impact method for producing images by the deposition of ink droplets in a pixel-by-pixel manner to an image-recording element in response to digital signals. There are various methods that may be utilized to control the deposition of ink droplets on the image-recording element to yield the desired image. In one process, known as continuous ink jet, a continuous stream of droplets is charged and deflected in an imagewise manner onto the surface of the image-recording element, while unimaged droplets are caught and returned to an ink sump. In another process, known as drop-on-demand ink jet, individual ink droplets are projected as needed onto the image-recording element to form the desired image. Common methods of controlling the projection of ink droplets in drop-on-demand printing include piezoelectric transducers and thermal bubble formation. Ink jet printers have found broad applications across markets ranging from industrial labeling to short run printing to desktop document and pictorial imaging.

The inks used in the various ink jet printers can be classified as either dye-based or pigment-based. A dye is a colorant that is molecularly dispersed or solvated by a carrier medium. The carrier medium can be a liquid or a solid at room temperature. A commonly used carrier medium is water or a mixture of water and organic co-solvents. Each individual dye molecule is surrounded by molecules of the carrier medium. In dye-based inks, no particles are observable under the microscope. Although there have been many recent advances in the art of dye-based ink jet inks, such inks still suffer from deficiencies such as low optical densities on plain paper, poor light-fastness and poor ozone-fastness in some porous image-receiving layers. When water is used as the carrier medium, such inks also generally suffer from poor water-fastness.

U.S. Pat. No. 6,087,051 relates to an ink jet recording element containing a protective overcoat layer of an aqueous polyurethane resin or an aqueous polyacryl resin. However, such an overcoat layer does not improve the image quality.

It is an object of this invention to provide an ink jet printing process for improving the durability of an ink jet image. It is another object of this invention to provide an ink jet printing process wherein the image quality is improved.

SUMMARY OF THE INVENTION

These and other objects are achieved in accordance with the present invention which comprises an ink jet printing process for improving the durability and image quality of an ink jet image comprising:

a) providing an ink jet recording element comprising a support having thereon an image-receiving layer containing an ink jet image; and b) applying over the surface of the image-receiving layer an overcoat layer of water-dispersible, smectite clay particles.

It was found that the durability and image quality of an ink jet image is improved using an overcoat layer of the smectite clay particles.

DETAILED DESCRIPTION OF THE INVENTION

In a preferred embodiment of the invention, the smectite clay is montmorillonite, hectorite or saponite. In another preferred embodiment, the smectite clay comprises synthetic smectite or layered hydrous magnesium silicate. The smectite clay overcoat layer can be applied at any thickness for the intended purpose. In general, good results have been obtained when the overcoat layer has a thickness of between about 0.1 and about 100 $\mu$m, preferably between about 0.25 and about 25 $\mu$m.

Ink jet inks used to prepare the images to be protected using the invention are well-known in the art. The ink compositions used in ink jet printing typically are liquid compositions comprising a solvent or carrier liquid, dyes or pigments, humectants, penetrants, buffers, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Any known ink jet image-receiving layer or ink solvent receiving layer can be used in the present invention. For example, these layers may consist primarily of inorganic oxide particles such as silicas, modified silicas, clays, aluminas, fusible beads such as beads comprised of thermoplastic or thermosetting polymers, non-fusible organic beads, or hydrophilic polymers such as naturally-occurring hydrophilic colloids and gums such as gelatin, albumin, guar, xantham, acacia, chitosan, starches and their derivatives, and the like; derivatives of natural polymers such as functionalized proteins, functionalized gums and starches, and cellulose ethers and their derivatives; and synthetic polymers such as polyvinyloxazoline, polyvinylmethyloxazoline, polyoxides, polyethers, poly (ethylene imine), poly(acrylic acid), poly(methacrylic acid), n-vinyl amides including polyacrylamide and polyvinylpyrrolidone, and poly(vinyl alcohol), its derivatives and copolymers; and combinations of these materials.

Hydrophilic polymers, inorganic oxide particles, and organic beads may be present in one or more layers on the substrate and in various combinations within a layer.

Examples of ink jet recording elements having glossy, non-porous image-receiving layers or ink solvent receiving layers which can be used in the present invention include HP Premium Inkjet Glossy Paper® and HP Premium Plus Photo paper, Glossy Media®.

A porous structure may be introduced into image-receiving layers or ink solvent receiving layers comprised of hydrophilic polymers by the addition of ceramic or hard polymeric particulates, by foaming or blowing during coating, or by inducing phase separation in the layer through introduction of nonsolvent. Commercial examples of ink jet recording elements containing small pore size glossy porous image-receiving layers or ink solvent receiving layers are Kodak Professional Instant—Dry Photographic Glossy Paper®, Konica QP Photo Quality Ink Jet Paper® and Epson Premium Glossy Photo Paper®. Papers with larger pore size, lower surface gloss or matte image-receiving layers are usually referred to as coated papers. Bond papers are examples where the porous substrate also acts as the image-receiving layer and ink solvent receiving layer.

In practice, various additives may be employed in the image-receiving layer, ink solvent receiving layer and overcoat. These additives include surface active agents, surfactant(s), to improve coatability and to adjust the surface tension of the dried coating, acid or base to control the pH, antistatic agents, suspending agents, hardening agents to cross-link the coating, antioxidants, UV stabilizers, light stabilizers, and the like. In addition, a mordant may be added in small quantities (2%–10% by weight of the base layer) to improve waterfastness. Useful mordants are disclosed in U.S. Pat. No. 5,474,843.

The layers described above, including the image-receiving layer, ink solvent receiving layer and the overcoat layer, may be coated by conventional coating means onto a transparent or opaque support material commonly used in this art. Coating methods may include, but are not limited to, spray coating, wound wire rod coating, slot coating, slide hopper coating, gravure, curtain coating, and the like. Some of these methods allow for simultaneous coatings of both layers, which is preferred from a manufacturing economic perspective.

The image-receiving layer may be present in any amount that is effective for the intended purpose. In general, good results are obtained when it is present in an amount of from about 5 to about 30 g/m$^2$, preferably from about 8 to about 15 g/m$^2$, which corresponds to a dry thickness of about 5 to about 30 $\mu$m, preferably about 8 to about 15 $\mu$m. In another embodiment, the image-receiving layer has a thickness of between about 1 and about 100 $\mu$m.

One type of natural occurring smectite clay that may be used in the invention is montmorillonite and another type is bentonite. Synthetic clay can be made, which closely resembles the natural clay mineral hectorite in both structure and composition, as disclosed in British Patents 1054111, 1213122 and U.S. Pat. No. 4,049,780. Synthetic smectite clay is free from natural impurities and is prepared under controlled conditions. One such synthetic smectite clay is commercially marketed under the tradename Laponite® by Laporte Industries, Ltd of UK through its US subsidiary, Southern Clay Products, Inc. It is a layered hydrous magnesium silicate, in which magnesium ions, partially replaced by suitable monovalent ions such as lithium, sodium or potassium, are octahedrally coordinated to oxygen and/or hydroxyl ions, some of which may be replaced by fluorine ions, forming the central octahedral sheet. Such an octahedral sheet is sandwiched between two tetrahedral sheets of silicon ions, tetrahedrally coordinated to oxygen.

There are many grades of Laponites® such as RD, RDS, J, S, etc. each with unique characteristics and can be used in the present invention. A typical chemical analysis of Laponite® and its physical properties, as per Laponite Product Bulletin, are provided below.

TABLE A

Typical Chemical Analysis

| Component | Weight % |
|---|---|
| $SiO_2$ | 54.5 |
| MgO | 26.0 |
| $Li_2O$ | 0.8 |
| $Na_2O$ | 5.6 |
| $P_2O_5$ | 4.1 |
| Loss on ignition | 8.0 |

TABLE B

Typical Physical Properties

| | |
|---|---|
| Appearance | White Powder |
| Bulk density | 1000 kg/m$^3$ |
| Surface Area | 330 m$^2$/g |
| pH (2% suspension) | 9.7 |
| Sieve analysis, | 98% <250 m |
| Moisture content | 10% |

Laponite® separates into tiny platelets of lateral dimension of 25–50 nm and a thickness of 1–5 nm in deionized aqueous dispersions. Typical concentration of Laponite® can be 0.1% through 10% when used to overcoat a printed image.

The clay overcoat layer may be applied to the ink jet image in accordance with the invention either through a separate thermal or piezoelectric printhead, or by any other method that would apply the material evenly to the image, such as a spray bar. Methods of applying a overcoat layer are disclosed in U.S. Pat. Nos. 6,176,574 and 6,254,230, the disclosures of which are incorporated herein by reference. Other methods for applying the overcoat layer include submerging the element into a tank containing a liquid dispersion of the clay or by extrusion of the clay dispersion on top of the recording element.

In general, the overcoat layer may be present at a dry thickness of from about 0.1 to about 100 $\mu$m, preferably from about 0.25 to about 25 $\mu$m.

The support for the ink jet recording element used in the invention can be any of those usually used for ink jet receivers, such as paper, including resin-coated paper and laminated paper based supports, and plastic film supports, including transparent, opaque and semi-transparent (day/night) supports based on polymers such as poly(ethylene terephthalate), poly(ethylene naphthalate), cellulose acetate, and microporous materials such as polymer-containing materials sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861.

The support used in the invention may have a thickness of from about 50 to about 500 μm, preferably from about 75 to 300 μm. Antioxidants, antistatic agents, plasticizers and other known additives may be incorporated into the support, if desired. In a preferred embodiment, either paper or poly(ethylene terephthalate) is employed.

In order to improve the adhesion of the image-receiving layer to the support, the surface of the support may be subjected to a corona-discharge-treatment prior to applying the image-receiving layer.

In addition, a subbing layer, such as a layer formed from a halogenated phenol or a partially hydrolyzed vinyl chloride-vinyl acetate copolymer can be applied to the surface of the support to increase adhesion of the image-receiving layer. If a subbing layer is used, it should have a thickness (i.e., a dry coat thickness) of less than about 2 μm.

The following example is provided to illustrate the invention.

EXAMPLE

Printing of Ink Jet Print

Various color patches were printed onto different receivers at various densities using a specified printer and cartridges containing colored and black dye or pigment based inks as described below.

Printer and Ink Combinations:

1. HP Deskjet 680® desktop printer equipped with a HP 51529a black pigment ink cartridge and a HP 51649a tri-color dye ink cartridge
2. HP Deskjet 990® Cxi desktop printer equipped with a HP 51645a black pigment ink cartridge and a HP C6578a tri-color dye ink cartridge
3. Epson Stylus Color 880® desktop printer equipped with an Epson #T019 201—black dye ink cartridge and an Epson #T020 201—tri-color dye ink cartridge
4. Lexmark Z51® desktop printer equipped with a Lexmark 12A1970 black dye ink cartridge and a Lexmark 15M0120 tri-color dye ink cartridge;

Receivers

A. HP Premium Inkjet Glossy Paper®
B. HP Premium Plus Photo Paper, Glossy®
C. Kodak Professional Instant—Dry Photographic Glossy Paper®
D. Konica QP Photo Quality Ink Jet Paper®
E. Epson Premium Glossy Photo Paper®
F. Hammermill Tidal DP Bond Paper®
G. Experimental prototype coated paper consisting of a 24 micron image receiving layer, containing 38.7 g. of Gasil® 23F supplied by Crossfield, 58.3 g. of Gohsenol® GH-17 supplied by Nippon Gohsei, 0.6 g. of Silwetg® L7602 supplied by OSi Specialties and 2.4 g. of Olin® 10G supplied by Olin, coated over a corona discharge treated resin coated paper support.
H. Kodak Inkjet Transparency Film®

Control Elements C-1 through C-24

These elements were printed using the ink-printer combination described in Table 1 below.

Elements 1-24 of the Invention

These elements were the same as the control elements except that they were overcoated with Laponite RD®, supplied by Southern Clay Product Co. (Gonzales, Tex.), mixed with deionized water to make a 3% gel, to form a layer of 2 μm using a hopper coating knife.

TABLE 1

| Element | Printer-Ink Combination | Receiver |
|---|---|---|
| C-1 | 1 | A |
| 1 | 1 | A |
| C-2 | 1 | B |
| 2 | 1 | B |
| C-3 | 1 | C |
| 3 | 1 | C |
| C-4 | 1 | D |
| 4 | 1 | D |
| C-5 | 2 | A |
| 5 | 2 | A |
| C-6 | 2 | B |
| 6 | 2 | B |
| C-7 | 2 | C |
| 7 | 2 | C |
| C-8 | 2 | D |
| 8 | 2 | D |
| C-9 | 3 | A |
| 9 | 3 | A |
| C-10 | 3 | B |
| 10 | 3 | B |
| C-11 | 3 | E |
| 11 | 3 | E |
| C-12 | 3 | C |
| 12 | 3 | C |
| C-13 | 3 | D |
| 13 | 3 | D |
| C-14 | 4 | A |
| 14 | 4 | A |
| C-15 | 4 | B |
| 15 | 4 | B |
| C-16 | 4 | C |
| 16 | 4 | C |
| C-17 | 4 | D |
| 17 | 4 | D |
| C-18 | 1 | F |
| 18 | 1 | F |
| C-19 | 1 | G |
| 19 | 1 | G |
| C-20 | 1* | A |
| 20 | 1* | A |
| C-21 | 1 | H |
| 21 | 1 | H |

*printed with the black pigment cartridge only

Testing

Optical Density

The reflection densities of the color patches were measured with a GretagMacbeth Spectrolino® Densitometer are shown in Table 2 below. The transmission densities of the color patches were measured with a X-Rite 310 ® Densitometer and are shown in Table 3 below.

Gloss

The 20° and 60° gloss of the elements were measured with a micro-TRI-glossmeter® manufactured by BYK Gardner and are shown in Table 2 below.

TABLE 2

| Element | Optical Density | | | | Gloss | |
|---|---|---|---|---|---|---|
| | Visual | Red | Green | Blue | 20° | 60° |
| C-1 | 1.8 | 1.84 | 1.73 | 1.81 | 24.3 | 67.8 |
| 1 | 2.53 | 2.63 | 2.46 | 2.57 | 66.2 | 84.4 |
| C-2 | 2.26 | 2.28 | 2.26 | 2.02 | 24.6 | 65.2 |
| 2 | 2.48 | 2.51 | 2.5 | 2.37 | 21.5 | 58.6 |
| C-3 | 1.6 | 1.61 | 1.61 | 1.27 | 35.6 | 78.1 |
| 3 | 2.4 | 2.6 | 2.35 | 1.74 | 53.9 | 87.4 |
| C-4 | 1.87 | 1.88 | 1.86 | 1.43 | 25.4 | 52.2 |
| 4 | 2.31 | 2.49 | 2.23 | 1.74 | 56.7 | 74.4 |
| C-5 | 2.08 | 2.27 | 2.04 | 1.94 | 44.6 | 71.7 |
| 5 | 2.29 | 2.58 | 2.19 | 2.1 | 71.8 | 89.3 |
| C-6 | 2.22 | 2.34 | 2.2 | 1.96 | 30.1 | 78.2 |
| 6 | 2.35 | 2.49 | 2.35 | 2.2 | 26.3 | 62.9 |
| C-7 | 1.45 | 1.62 | 1.34 | 1.33 | 29.2 | 73.7 |
| 7 | 1.96 | 2.53 | 1.73 | 1.44 | 40.8 | 84.6 |
| C-8 | 1.61 | 1.9 | 1.45 | 1.24 | 27.6 | 52.8 |
| 8 | 1.87 | 2.34 | 1.66 | 1.38 | 68.4 | 88.5 |
| C-9 | 2.51 | 2.52 | 2.51 | 2.39 | 51.4 | 80.6 |
| 9 | 2.66 | 2.68 | 2.67 | 2.62 | 31.45 | 71.1 |
| C-10 | 2.38 | 2.39 | 2.41 | 2.33 | 30.9 | 72.1 |
| 10 | 2.74 | 2.73 | 2.82 | 2.75 | 19.4 | 46.4 |
| C-11 | 2.43 | 2.49 | 2.38 | 2.21 | 27.2 | 52.4 |
| 11 | 2.35 | 2.38 | 2.33 | 2.17 | 81 | 92.2 |
| C-12 | 1.95 | 1.98 | 1.92 | 1.85 | 35.4 | 74.5 |
| 12 | 2.22 | 2.2 | 2.2 | 2.21 | 56 | 83.5 |
| C-13 | 2.32 | 2.42 | 2.25 | 2.12 | 27.6 | 54.9 |
| 13 | 2.25 | 2.29 | 2.21 | 2.13 | 69.5 | 90.1 |
| C-14 | 2.18 | 2.11 | 2.22 | 2.16 | 33.4 | 75.25 |
| 14 | 2.54 | 2.53 | 2.54 | 2.48 | 67.2 | 84.4 |
| C-15 | 2.28 | 2.17 | 2.32 | 2.01 | 22.9 | 74.9 |
| 15 | 2.54 | 2.37 | 2.65 | 2.33 | 21.9 | 55.35 |
| C-16 | 1.76 | 1.78 | 1.75 | 1.31 | 34.9 | 71.5 |
| 16 | 2.02 | 1.92 | 2.09 | 1.56 | 55.9 | 85.6 |
| C-17 | 1.89 | 2.18 | 1.73 | 1.24 | 25.9 | 51.45 |
| 17 | 1.93 | 2.2 | 1.75 | 1.44 | 71.3 | 94.75 |
| C-18 | 0.36 | 0.59 | 0.43 | 0.5 | NA | NA |
| 18 | 0.3 | 0.81 | 0.51 | 0.73 | NA | NA |
| C-19 | 1.3 | 1.4 | 1.53 | 1.4 | NA | NA |
| 19 | 1.6 | 1.69 | 1.82 | 1.5 | NA | NA |
| C-20 | 1.65 | 1.67 | 1.63 | 1.56 | NA | NA |
| 20 | 2.35 | 2.45 | 2.29 | 2.13 | NA | NA |

The above results show that the optical density or the gloss of the images are enhanced greatly after applying the overcoat. This enhancement is generally observed on images printed on different media using different printers with different inks.

TABLE 3

| Element | Transmission density | | | |
|---|---|---|---|---|
| | Visual | Red | Green | Blue |
| C-21 | 1.69 | 0.84 | 0.62 | 1.16 |
| 21 | 2.09 | 1.76 | 1.51 | 1.46 |

The above results show that the transmission densities of the images printed on a transparency are also enhanced greatly after applying the overcoat.

Ozone Resistance

The elements in the form of strips measuring approximately 2.54 cm×20 cm or smaller were introduced into a chamber set to deliver 5 ppm of ozone at approximately 50 l/min total flow and a dew point of about 11° C. The color densities on each of the samples were measured before and after a 65 hour ozone exposure. The optical densities after ozone exposure are shown in Table 4 below and should be compared to the optical densities in Table 2 for the same elements.

Blocking

The elements in the form of squares measuring approximately 7.6 cm×7.6 cm were placed into the 70° C./50% RH oven and allowed to equilibrate for a half hour. The two density patches were placed face to face imagewise. The patches were inserted into a metal box and a kilogram cover was applied. The samples were left in the oven for six hours. After removal from the oven and from the box, the samples were allowed to cool for at least thirty minutes. Finally, the samples were separated slowly and the performance was rated as stated below:

Pass—no sticking or some sticking with no image degradation

Fail—no sticking or some sticking with some image degradation

The results are shown in Table 4 below.

TABLE 4

| Element | Optical density after ozone exposure | | | | |
|---|---|---|---|---|---|
| | Visual | Red | Green | Blue | Blocking |
| C-1 | NT | NT | NT | NT | fail |
| 1 | NT | NT | NT | NT | pass |
| C-2 | NT | NT | NT | NT | fail |
| 2 | NT | NT | NT | NT | pass |
| C-5 | NT | NT | NT | NT | fail |
| 5 | NT | NT | NT | NT | pass |
| C-9 | NT | NT | NT | NT | fail |
| 9 | NT | NT | NT | NT | pass |
| C-10 | NT | NT | NT | NT | fail |
| 10 | NT | NT | NT | NT | pass |
| C-11 | 1.29 | 0.94 | 1.62 | 1.94 | NT |
| 11 | 2.31 | 2.34 | 2.28 | 2.17 | NT |
| C-12 | 1.36 | 1.11 | 1.52 | 1.65 | NT |
| 12 | 2.14 | 2.12 | 2.12 | 2.1 | NT |
| C-13 | 0.53 | 0.35 | 0.68 | 1.56 | NT |
| 13 | 2.36 | 2.39 | 2.35 | 2.24 | NT |

*NT: not tested

The above results, comparing the same elements in Tables 2 and 4, show that the images with overcoat did not lose their optical density after accelerated ozone testing in contrast to the images without overcoat. The overcoat provides good protection of the images from heat and pressure. The prints with overcoat do not exhibit any image degradation after the blocking test in contrast to the prints without the overcoat.

Although the invention has been described in detail with reference to certain preferred embodiments for the purpose of illustration, it is to be understood that variations and modifications can be made by those skilled in the are without departing from the spirit and scope of the invention.

What is claimed is:

1. An ink jet printing process for improving the durability and image quality of an ink jet image comprising:

a) providing an ink jet recording element comprising a support having thereon an image-receiving layer containing an ink jet image; and b) applying over the surface of said image-receiving layer a composition consisting essentially of an aqueous dispersion of water-dispersible, smectite clay particles in the amount of 0.1 to 10 weight percent, thereby forming an overcoat layer having a thickness of between 0.25 and 25 $\mu$m.

2. The process of claim 1 wherein said smectite clay is montmorillonite, hectorite or saponite.

3. The process of claim 1 wherein said smectite clay comprises synthetic smectite.

4. The process of claim 1 wherein said smectite clay comprises layered hydrous magnesium silicate.

5. The process of claim 1 wherein said image-receiving layer has a thickness of between about 1 and about 100 $\mu$m.

6. The process of claim 1 wherein said overcoat layer is applied by means of an ink jet print head.

7. The process of claim 1 wherein said overcoat layer is applied by using a spray bar.

8. The process of claim 1 wherein said overcoat layer is applied by submerging said element in a tank containing a liquid dispersion of said smectite clay.

9. The process of claim 1 wherein said overcoat layer is applied by hopper coating.

10. The process of claim 1 wherein said support is paper.

11. The process of claim 1 wherein said support is resin-coated paper.

12. The process of claim 1 wherein said support is a plastic film.

13. An ink jet printing process for improving the durability and image quality of an ink jet image comprising:

a) providing an ink jet recording element comprising a support having thereon an image-receiving layer containing an ink jet image; and b) applying over the surface of said image-receiving layer a composition consisting essentially of an aqueous dispersion of water-dispersible, smectite clay particles in the amount of 0.1 to about 3 weight percent, thereby forming an overcoat layer having a thickness of between 0.25 and about 2 $\mu$m.

* * * * *